US008387405B2

(12) United States Patent
Johnson

(10) Patent No.: US 8,387,405 B2
(45) Date of Patent: Mar. 5, 2013

(54) ANTIMICROBIAL ULTRAVIOLET LIGHT SYSTEM FOR REFRIGERATOR SANITATION

(76) Inventor: Edward Johnson, Fort Hood, TX (US)

( * ) Notice: Subject to any disclaimer, the term of this patent is extended or adjusted under 35 U.S.C. 154(b) by 258 days.

(21) Appl. No.: 13/035,332

(22) Filed: Feb. 25, 2011

(65) Prior Publication Data

US 2012/0051030 A1 Mar. 1, 2012

Related U.S. Application Data

(60) Provisional application No. 61/308,359, filed on Feb. 26, 2010.

(51) Int. Cl.
*F21V 33/00* (2006.01)

(52) U.S. Cl. ..... 62/264; 62/177; 362/92

(58) Field of Classification Search ..... 62/264, 62/177, 78; 362/92
See application file for complete search history.

(56) References Cited

U.S. PATENT DOCUMENTS 2,622,409 A 12/1952 Stirnkorb
5,901,564 A 5/1999 Comeau, II
6,477,853 B1 * 11/2002 Khorram ..... 62/264
2002/0174674 A1 * 11/2002 Takahashi et al. ..... 62/264
2006/0260341 A1 11/2006 Meyvis
2008/0307818 A1 12/2008 Min et al.
2009/0183523 A1 * 7/2009 Willette ..... 62/264

* cited by examiner

*Primary Examiner* — Anh Mai
*Assistant Examiner* — Elmito Breval
(74) *Attorney, Agent, or Firm* — Mark D. Bowen; Malin Haley DiMaggio & Bowen, P.A.

(57) ABSTRACT

A refrigerator is adapted to include a plurality of ultraviolet light bars, which may be adjustably connected to sufficiently radiate UV light throughout the refrigerator compartment in connection with a control box and power cord which operate to control the bacterial level present on and around foodstuffs being stored therein. A series of UV light bars are capable of being arranged and plugged into one another by daisy chain to allow for a timer-controlled illumination of UV light to radiate throughout the compartment. Sensors in the control box signal the timer, and a wire ribbon extending from the control box provides a connection to the external power source without significantly affecting the seal of the refrigerator door. Power is supplied to the UV light sources via a ribbon-type power cable passing from the refrigerator interior compartment to the exterior by passing between the refrigerator and the refrigerator door and over the peripheral gasket, whereby power may be supplied to said control box by connection of said male electrical plug to an electrical outlet without significantly affecting the integrity of the thermal seal.

6 Claims, 6 Drawing Sheets

ANTIMICROBIAL ULTRAVIOLET LIGHT SYSTEM FOR REFRIGERATOR SANITATION

CROSS REFERENCE TO RELATED APPLICATIONS

This application claims the benefit of provisional U.S. Patent Application Ser. No. 61/308,359, filed on Feb. 26, 2010.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to an antimicrobial ultraviolet light system for refrigerator sanitation, and more particularly to a plurality of connectable ultraviolet lights for use with a refrigerator, for the purpose of reducing bacterial growth and maintaining a sanitary environment inside the refrigerator compartment, wherein power is supplied from an electrical household outlet via a thin ribbon-type power cable routed from the refrigerator interior to the exterior through the door seal.

2. Description of Related Art

A refrigerator is a well known appliance intended to cool the contents thereof below ambient temperature. The internal temperature, which is typically maintained slightly above the freezing point of water, prevents bacterial growth from spoiling foodstuffs. Without refrigeration, naturally-occurring bacteria begin to affect food and cause it to spoil. The constant cooling effect of the thermally insulated refrigerator allows for the increased lifespan of food products, as bacterial reproduction and growth is reduced in colder temperatures. Eventually, however, bacteria will spoil food. Ultraviolet light has been known, in various applications, to prevent such spoliation by destroying some of the bacterial organisms. UV light is electromagnetic radiation with a wavelength shorter than that of visible light, but longer than X-rays, in the range 10 nm to 400 nm, and energies from 3 eV to 124 eV. It is so named because the spectrum consists of electromagnetic waves with frequencies higher than those that humans identify as the color violet.

The use of ultraviolet ("UV") light to disinfect the internal compartment of refrigerators has been the topic of various patents. For example, U.S. Pat. No. 2,622,409 issued to Stirnkorb, discloses a plurality of small, low current UV lights which utilize the standard circuitry of the refrigerator to power the UV light source. U.S. Pat. No. 5,901,564 issued to Comeau, II, discloses a UV lamp installed in the top portion of the refrigerator and reflective lining throughout to reflect the UV radiation throughout the compartment. U.S. Pat. No. 6,477,853 issued to Khorran, discloses a UV system with a single UV source attached to the internal sidewall of the refrigerator to radiate light to the entire compartment, or in the alternative, provide UV exposure to a limited compartment. U.S. Patent Publication No. 2006/0260341 issued to Meyvis, discloses an air cleaner for the internal compartment of a refrigerator which utilizes a UV filter to reduce pathogens in the re-circulated air. U.S. Patent Publication No. 2008/0307818 issued to Min et al, discloses a refrigerator with UV light irradiation components to eradicate low-level light from the storage containers contained therein to promote freshness of foodstuffs.

While refrigerators have been widely used to maintain freshness of foods stored therein, and several UV light devices for use in connection with refrigerators have been disclosed in the prior art, none adequately address the issue of food spoliation. The systems of the background art fail to provide ease of installation, adaptable light device configurations, suitable power supply integration, and inadequate control systems.

As a result of such limitations, the systems of the background art have achieved limited acceptance and commercial success. Accordingly, there remains a need in the art for further innovation and advancement in the art of providing UV light sources that provide full and complete distribution of UV light throughout the refrigerator compartment to promote freshness of stored foods while providing simple and effective power supply integration.

BRIEF SUMMARY OF THE INVENTION

The present invention overcomes the limitations and disadvantages present in the art by providing a UV light system which is readily adaptable for installation and use with virtually any conventional refrigerator to aid in maintaining the refrigerator substantially free of germs, bacteria, and the like without the use of harmful chemicals. In accordance with the present invention a plurality of elongate UV light bars are provided, including a first stage light system electrically connected to a control box having a power cord. Additional UV light bars may be used and electrically connected in series (i.e. daisy chain fashion) with the first stage light system to provide sufficient coverage for virtually any size refrigerator.

Each UV light bar includes a UV light housed within an impact resistant housing including a UV reflecting surface which functions to protect the light and direct the UV light generally downward. Each light bar further includes means for removable affixation thereof within a refrigerator, preferably adaptable for affixation to wire shelves and/or glass shelves. In a preferred embodiment, the means for removable fixation includes a pair of hooks that function to allow the light bars to be suspended from a wire shelf. In addition, the hooks may be adapted with suction cups to allow the light bars to be suspended from a glass shelf.

As noted above, the first stage UV light system includes a control box and power cable. A significant aspect of the present invention involves use of a thin ribbon-wire power cable that provides power to the control box from an external electrical outlet. In accordance with a preferred embodiment, the power cable is fabricated from a thin ribbon wire which is intended to pass through the refrigerator sealing door gasket without significantly affecting the peripheral seal which prevents cold air from escaping from the interior of the refrigerator so as to allow the system to receive power from a conventional electrical outlet. The control box, includes a white incandescent light sensor, a variable timer knob, and a fault indicator light. The white incandescent light sensor senses when the refrigerator door is opened. Once the door closes, the sensor triggers the UV light to illuminate for a specified period of time. If the door is reopened while the UV light is illuminating the compartment, the sensor will temporarily turn off the UV light and reset itself to cycle again once the door is closed. The timer may be adjusted to meet the needs of the user by allowing for adjustment of desired UV activation (e.g. illumination "on" time"). A fault indicator light illuminates when the UV light is illuminated. Should the incandescent sensor fail to interrupt the UV light cycle, the indicator light will alert the user that there may be a system malfunction. The fault indicator feature is significant since UV light is not within the spectrum of light that is visible to the human eye. Thus, the user would not be able to detect a malfunction wherein the sensor fails to deactivate the UV light source(s).

Accordingly, it is an object of the present invention to provide advancements in the field anti-bacterial sanitation of refrigerator compartments by way of ultraviolet light radiation.

Another object of the present invention is to provide an adjustable assembly of UV light bars, control box, and power cord to provide maximum coverage of UV light filtration throughout the refrigerator compartment.

Another object of the present invention is to provide an easy-to-install and economically practical method for reducing the spoliation of foodstuffs while stored in a refrigerator.

Yet another object of the present invention is to provide an independent power connection for the apparatus such that the seal of the refrigerator door is not compromised by ambient airflow into the compartment.

These and other objects are met by the present invention which will become more apparent from the accompanying drawing and the following detailed description of the drawings and preferred embodiments.

DETAILED DESCRIPTION OF THE INVENTION

Figure 1:
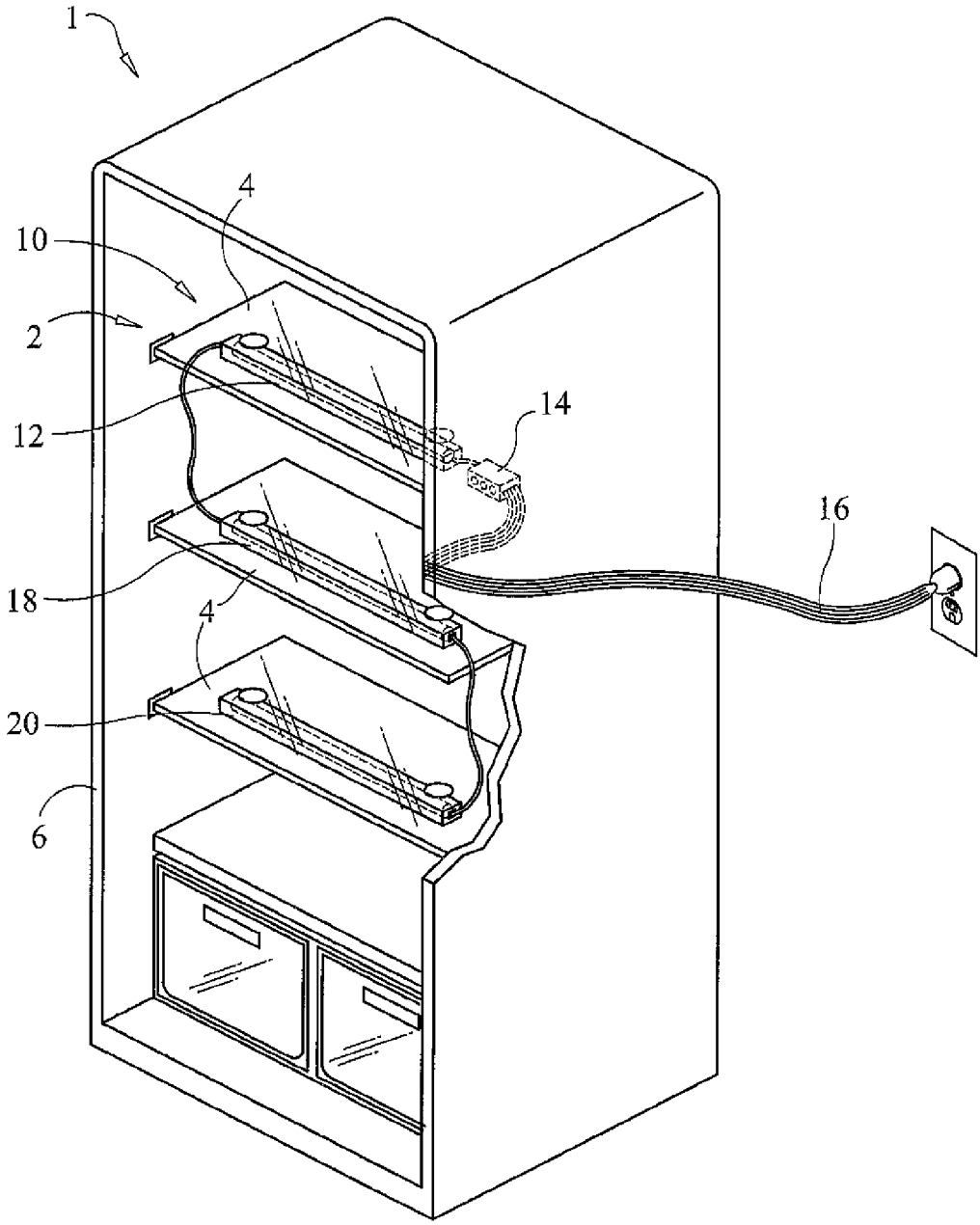
FIG. 1 is a front perspective illustration of a refrigerator adapted with a refrigerator sanitation assembly in accordance with the present invention.

With reference now to the drawings, FIGS. 1-6 depict a preferred embodiment of a refrigerator UV light system, generally referenced as 10, that overcomes the limitations and disadvantages present in the art in accordance with the present invention. A food storage refrigerator, generally referenced as 1, defines an internal compartment 2 bounded by an opening and containing at least one shelf 4, the refrigerator further includes a door 5 configurable between a closed configuration and a closed configuration and a gasket 6, wherein the gasket forms a thermal seal between the refrigerator and the door when the door is in the closed configuration. Gasket 6 may be affixed to the door, or to the refrigerator main body. The refrigerator further includes an internal light that illuminates when said door is in the open configuration.

Refrigerator UV light system is readily adaptable for installation and use with virtually any conventional refrigerator to aid in maintaining the refrigerator substantially free of germs, bacteria, and the like without the use of harmful chemicals. A UV light emitting source comprising a first stage UV light bar 12 is electrically connected to a control box 14 having a power cord 16. First stage light bar 12 further includes an auxiliary electrical connection port to allow for the electrical connection of an additional light bar thereto. More particularly, additional UV light sources, such as light bars referenced as 18 and 20, may be used and electrically connected in series (i.e. daisy chain fashion) with the first stage light bar to provide sufficient coverage for virtually any size refrigerator. Electrical power is provided from the first stage light bar 12 to each additional light bar.

Figure 2:
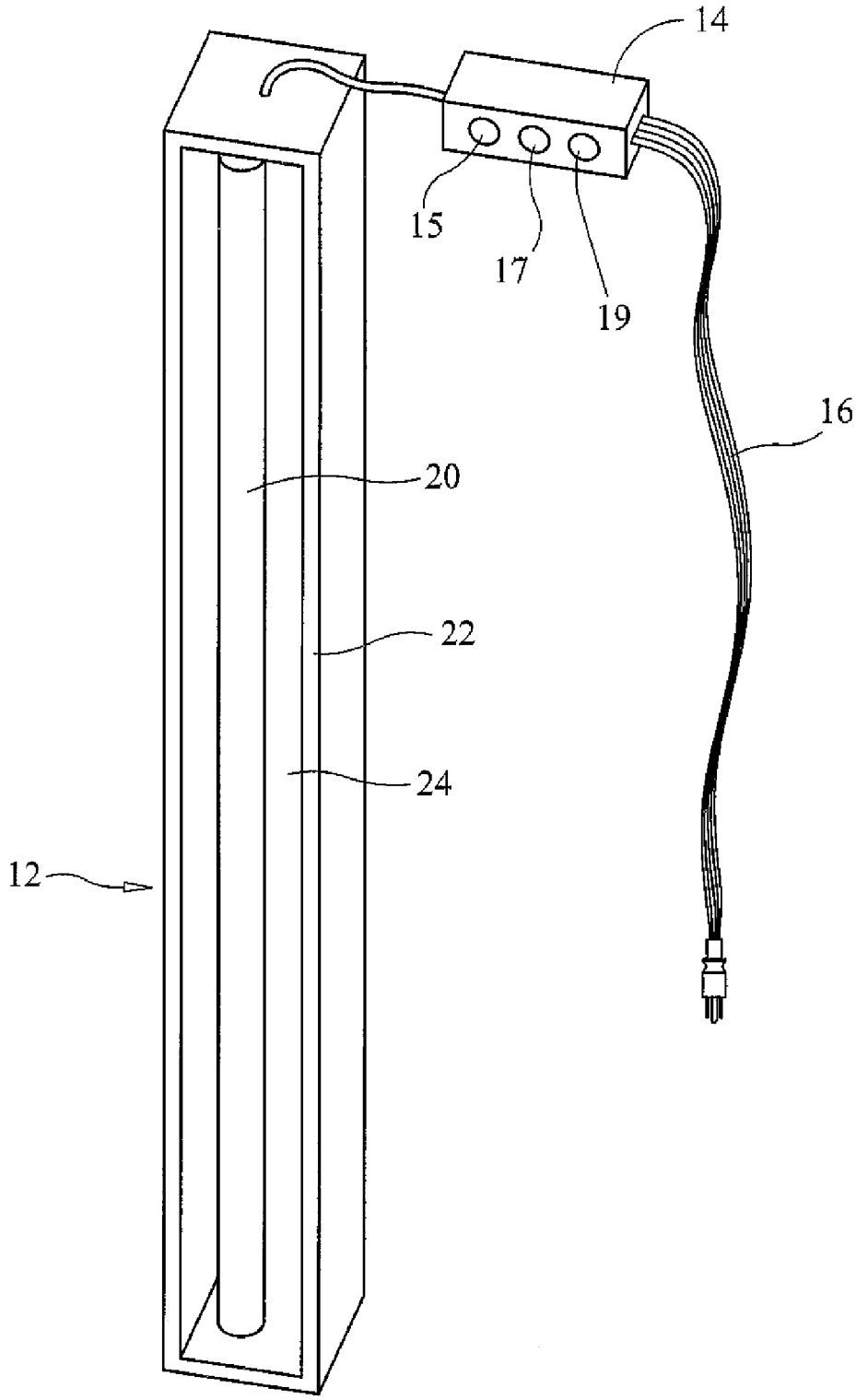
FIG. 2 illustrates a first stage light assembly electrically connected to a control box having a ribbon wire power cord.
Figure 3:
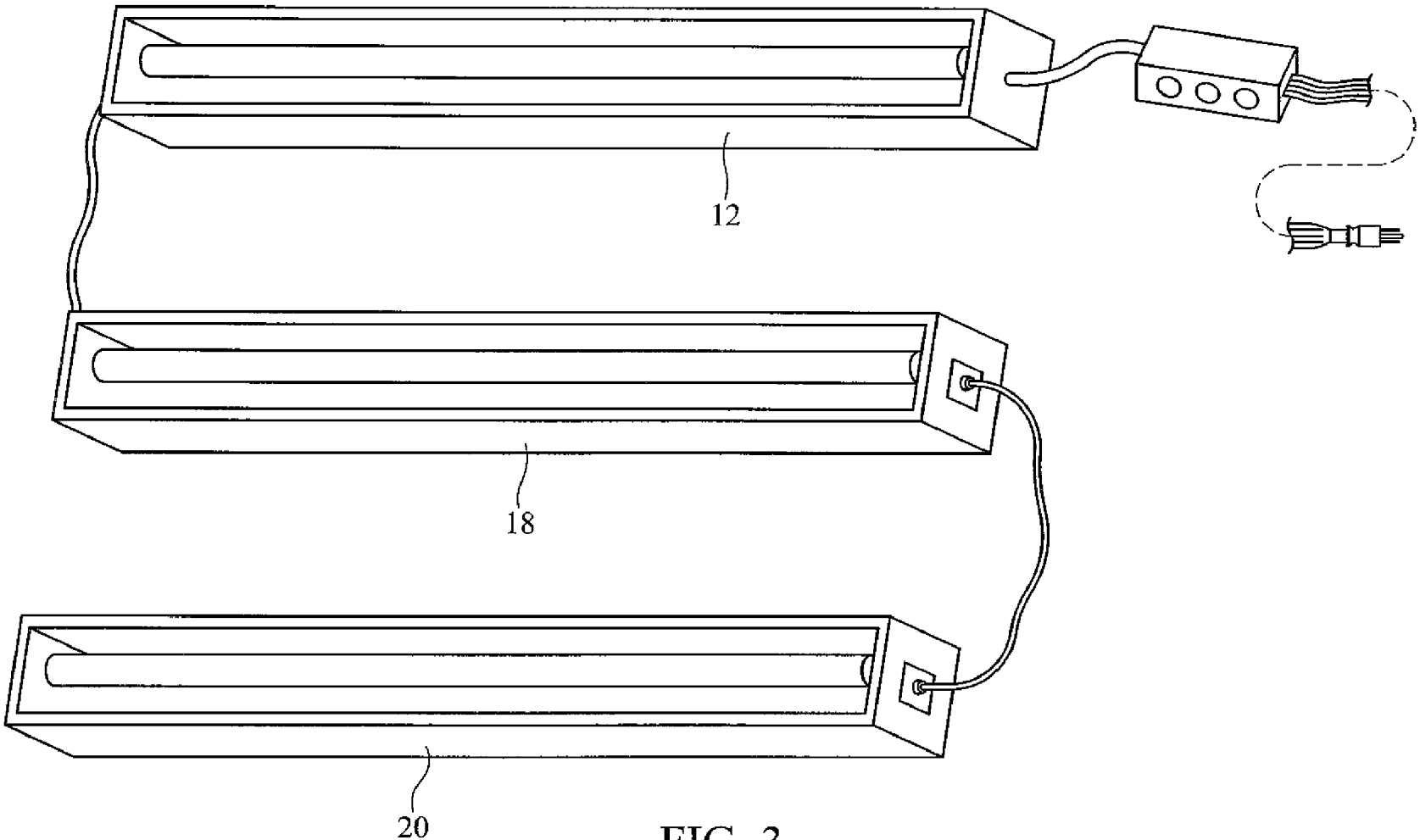
FIG. 3 illustrates electrical connection of a plurality of light assemblies in series.

As best illustrated in FIG. 2, each UV light bar includes a UV light 20 for providing a source of germicidal ultraviolet radiation. A cylindrical instant start UV lamp emitting a wavelength of 253.7 nm is considered suitable for use with the present invention. UV light 20 is preferably housed within an impact resistant housing 22 which includes a UV reflecting surface 24 that functions to protect the light and to direct the UV light generally downward, e.g. to cast the light on the contents of the refrigerator. Each light bar further includes means for removable affixation thereof within a refrigerator, preferably to allow for the affixation of the light bar to wire shelves and/or glass shelves. In a preferred embodiment, the means for removable fixation includes a pair of hooks 26 that function to allow the light bars to be suspended from a wire shelf. In addition, the hooks may be adapted with or replaced by suction cups 28 to allow the light bars to be suspended beneath glass shelf.

Figure 4:
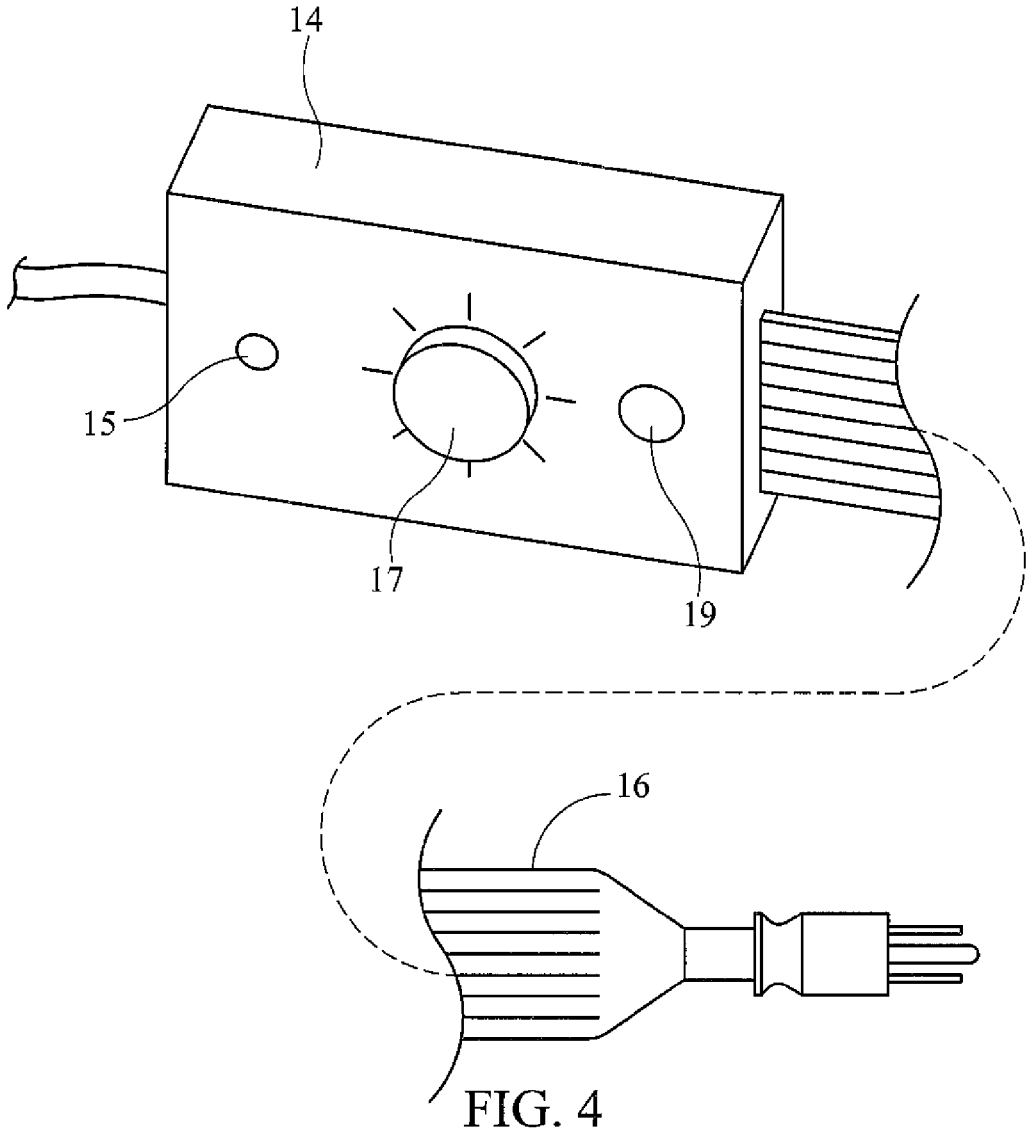
FIG. 4 illustrates a control box and ribbon power cable in accordance with the present invention.
Figure 5:
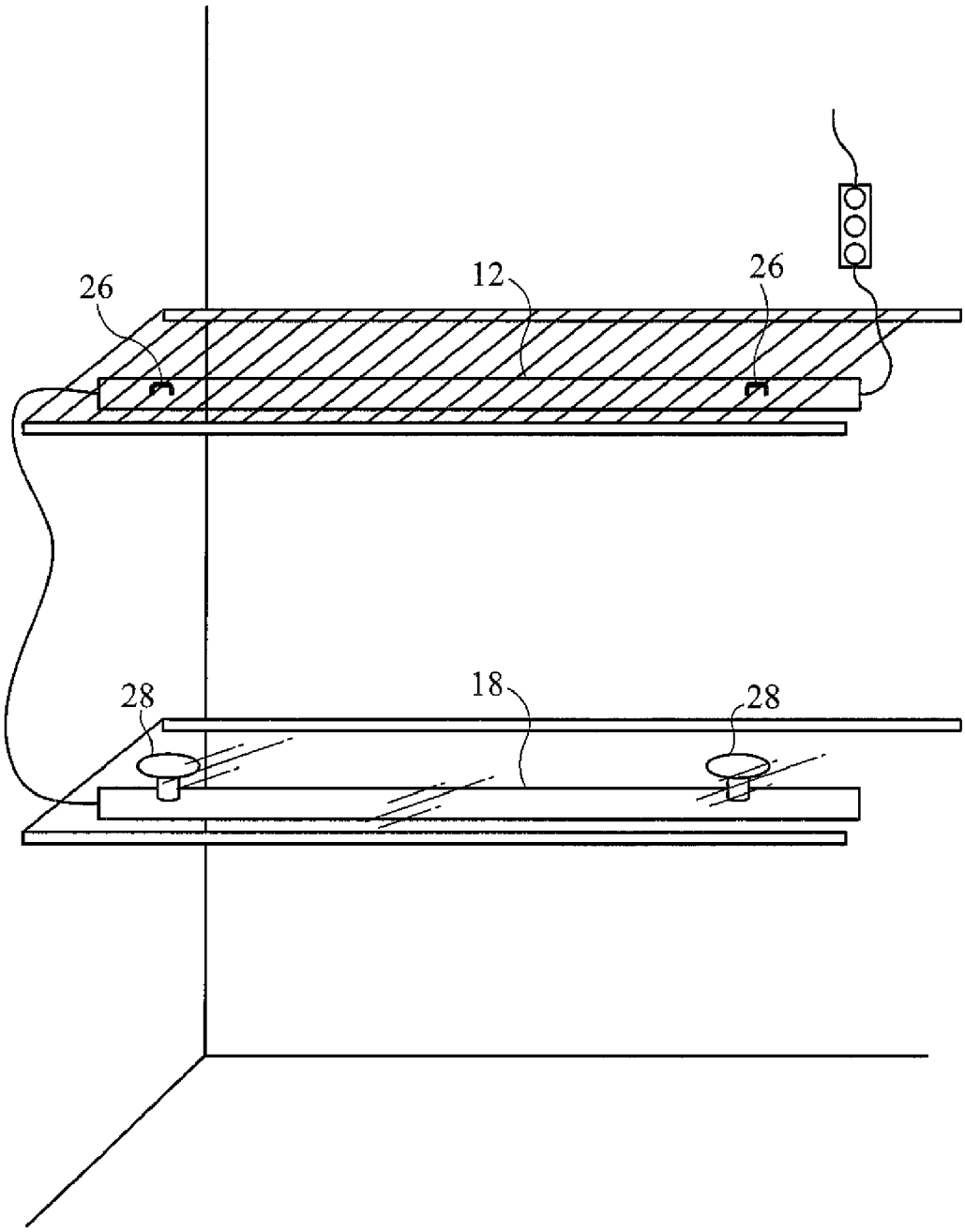
FIG. 5 is a perspective view illustrating alternate mounting configurations for light bar assemblies in accordance with the present invention.
Figure 6:
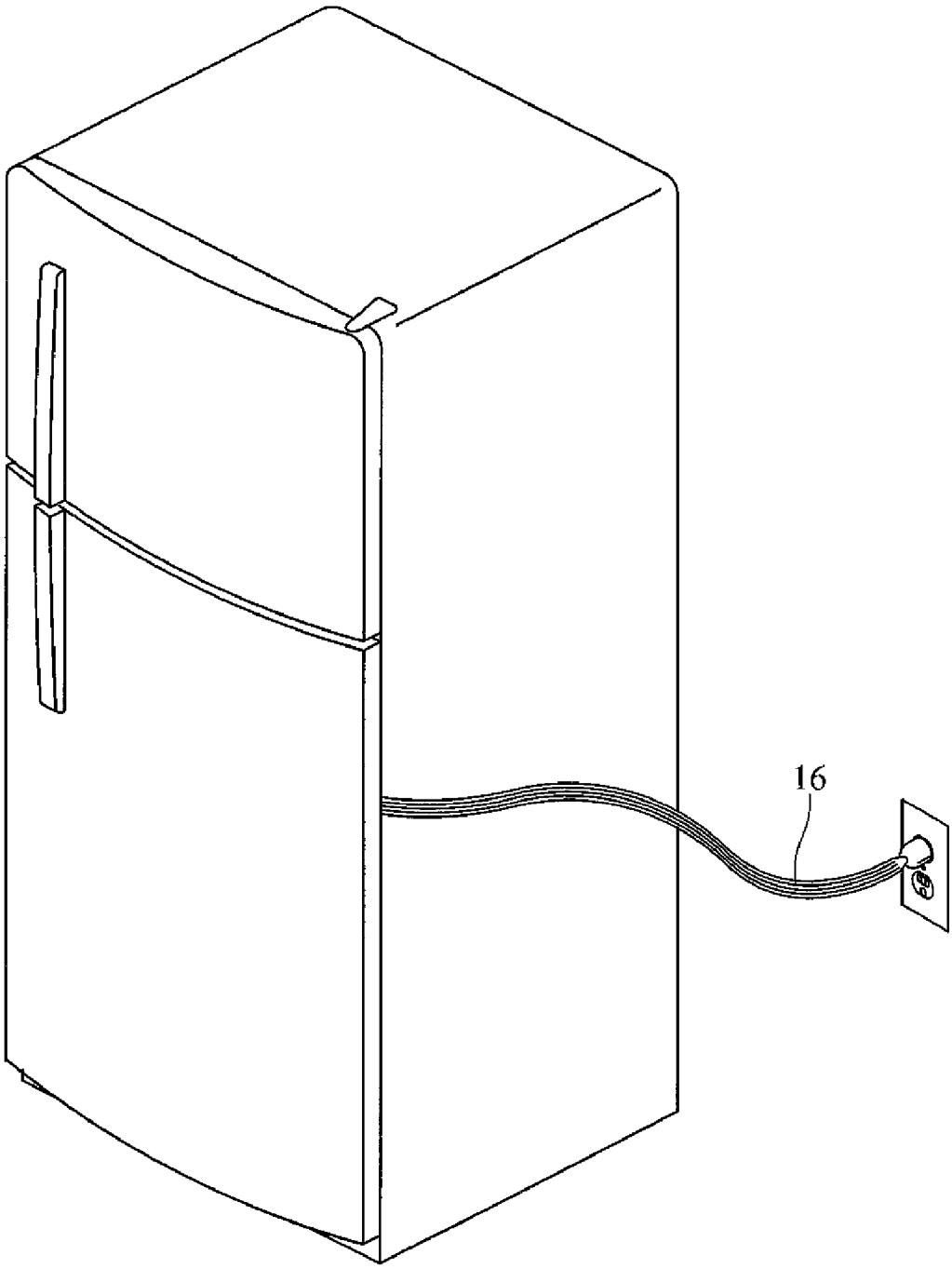
FIG. 6 is a front perspective view of a refrigerator having an closed door illustrating the routing of a ribbon wire power cable between the door and main refrigerator body in accordance with the present invention.

As best seen in FIG. 4, the first stage UV light system 12 includes a control box 14 and power cable 16. Power cable 16 comprises a thin ribbon wire power cable that provides power to the control box from an external electrical outlet. In accordance with a preferred embodiment, the thin ribbon wire is intended to pass through the refrigerator sealing door gasket without significantly affecting the peripheral seal which prevents cold air from escaping from the interior of the refrigerator. Control box 14 includes a light sensor 15 a variable timer knob 17, a fault indicator light 19, and otherwise conventional mechanical and electrical components to accomplish the functions disclosed herein. Light sensor 15 comprises a white light sensor so as to be triggered when sensing white light (such as the light emitted by the typical refrigerator interior light when the door is open), but not triggered by the UV lights of the system. As used herein the term "white light sensor" shall refer to a sensor calibrated to detect generally white light given off by an incandescent or fluorescent light bulb, or other light emitting device, but shall not detect or be triggered by UV light. More particularly, light sensor 15 senses when the refrigerator door is open by detecting the light given off by the white incandescent refrigerator light upon opening of the door. Once the door closes and the light goes off, the light sensor triggers the UV light(s) to illuminate for a specified period of time. If the door is reopened while the UV light(s) is illuminating, the sensor will cause the UV lights to temporarily turn off and reset the control sequence to cycle again once the door is closed.

A further significant aspect of the present invention involves providing for adjustment of UV illumination duration. More particularly, variable timer knob 17 functions to allow for user adjustment of UV illumination per cycle such that the user may selectively increase or decrease the period of UV illumination for each illumination cycle. This feature allows the user to adapt the system to provide a greater or lesser degree of UV exposure to items contained within the refrigerator.

Another significant aspect of the present invention relates to the provision of a fault indicator light 19. More particularly, fault indicator light 19 is electrically configured to visibly illuminate when the UV lights are illuminated. Thus, should the light sensor fail to interrupt the UV light cycle, such as when the door is opened, the fault indicator light will alert the user that there may be a system malfunction . . . namely the failure of the system to properly deactivate the UV lights. The fault indicator feature is significant since UV light is not within the spectrum of light that is visible to the human eye. Thus, the user would not be able to detect a malfunction wherein the sensor fails to deactivate the UV light source(s). Since the UV light is not visible, it is possible that a user would be harmed by prolonged, yet unnoticed, exposure to the UV lights while placing items in, or removing items from, the refrigerator.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An antimicrobial ultraviolet light system for use in a food storage refrigerator having main body defining an internal compartment with at least one shelf, said refrigerator defining an opening, said refrigerator further including a door and a gasket, said door configurable between a closed configuration wherein the gasket forms a thermal seal between the refrigerator and the door, and an open configuration, said refrigerator including an internal light that illuminates when said door is in the open configuration, said system comprising:

a UV light source including means for removable attachment thereof to a shelf within the refrigerator;

a control box electrically connected to said UV light source and disposed within the refrigerator, said control box including a white light sensor adapted for activating said UV light source for a predetermined period after the refrigerator door is closed thereby causing the refrigerator internal light to turn off;

a ribbon-type power cable having one end thereof electrically connected to said control box, and an opposing end terminating in a male electrical plug adapted for mating connection with a conventional electrical outlet, and said ribbon-type power cable passing from the refrigerator interior compartment to the exterior by passing between the refrigerator main body and the door, whereby power may be supplied to said control box by connection of said male electrical plug to an electrical outlet without significantly affecting the integrity of the thermal seal.

2. An antimicrobial ultraviolet light system according to claim 1, further including means for user adjustment of said UV illumination cycle whereby the user may selectively increase or decrease the UV illumination cycle.

3. An antimicrobial ultraviolet light system according to claim 1, further including a fault indicator light that illuminates in the event of a malfunction.

4. An antimicrobial ultraviolet light system for use in a food storage refrigerator having an internal compartment with at least one shelf, said refrigerator defining an opening and including a peripheral gasket surrounding said opening, said refrigerator further including a door configurable between a closed configuration wherein the gasket forms a thermal seal between the refrigerator and the door, and an open configuration, said refrigerator including an internal light that illuminates when said door is in the open configuration, said system comprising:

a plurality of UV light bars, each light bar including a UV light affixed within an impact resistant housing, and a UV reflecting surface disposed within said housing, said housing including means for removable attachment thereof to a shelf within the refrigerator, said housing further including an auxiliary electrical connection port;

said plurality of UV light bars including a first stage UV light bar adapted with a control box electrically connected thereto, said control box being disposed within the refrigerator internal compartment, said control box including a white light sensor adapted to activate UV illumination for a predetermined period of time after the refrigerator door is closed and the refrigerator internal light goes off;

a ribbon-type power cable having one end electrically connected to said control box and an opposing second end terminating in a male electrical plug adapted for mating connection with a conventional electrical outlet;

said ribbon-type power cable passing from the refrigerator interior compartment to the exterior by routing between the refrigerator and the refrigerator door and over the peripheral gasket, whereby power may be supplied to said control box by connection of said male electrical plug to an electrical outlet without significantly affecting the integrity of the thermal seal;

said plurality of UV light bars including at least one second stage light bar electrically connected to said first stage light bar.

5. An antimicrobial ultraviolet light system according to claim 4, further including means for user adjustment of said UV illumination whereby the user may selectively increase or decrease the duration of UV illumination.

6. An antimicrobial ultraviolet light system according to claim 4, further including a fault indicator light that illuminates in the event of a malfunction.

* * * * *